United States Patent [19]

Amin et al.

[11] Patent Number: 5,015,161

[45] Date of Patent: May 14, 1991

[54] MULTIPLE STAGE ORBITING RING ROTARY COMPRESSOR

[75] Inventors: Jayendra J. Amin, Pontiac; Guntis V. Strikis, Belleville, both of Mich.

[73] Assignee: Ford Motor Company, Dearborn, Mich.

[21] Appl. No.: 362,636

[22] Filed: Jun. 6, 1989

[51] Int. Cl.[5] ..... F04C 2/344; F04C 23/00

[52] U.S. Cl. ..... 418/6; 418/11; 418/59

[58] Field of Search ..... 418/3, 6, 11, 59, 13

[56] References Cited

U.S. PATENT DOCUMENTS

| | | | |
|---|---|---|---|
| 2,695,597 | 11/1954 | Griffiths | 418/59 |
| 2,965,288 | 12/1960 | Butler | 418/11 X |
| 4,086,042 | 4/1978 | Young . | |
| 4,219,314 | 8/1980 | Haggerty . | |
| 4,452,570 | 6/1984 | Fujisaki et al. . | |
| 4,452,571 | 6/1984 | Koda et al. . | |
| 4,507,064 | 3/1985 | Kocher et al. . | |
| 4,558,993 | 12/1985 | Hori et al. . | |
| 4,624,630 | 11/1986 | Hirahara et al. . | |
| 4,628,963 | 12/1986 | Ishijima et al. . | |
| 4,636,152 | 1/1987 | Kawaguchi et al. . | |
| 4,697,994 | 10/1987 | Ishizawa et al. | 418/13 X |
| 4,780,067 | 10/1988 | Suzuki et al. . | |
| 4,781,549 | 11/1988 | Caillat . | |
| 4,782,569 | 11/1988 | Wood . | |

FOREIGN PATENT DOCUMENTS

| | | | |
|---|---|---|---|
| 3536714 | 4/1986 | Fed. Rep. of Germany | 418/6 |
| 652350 | 3/1979 | U.S.S.R. | 418/6 |
| 914812 | 3/1982 | U.S.S.R. | 418/6 |

*Primary Examiner*—Michael Koczo

*Attorney, Agent, or Firm*—Frank G. McKenzie; Donald J. Harrington

[57] ABSTRACT

A gas compressor includes a housing defining a compression chamber, a crankshaft having an eccentric surface radially offset from the axis of rotation of the crankshaft, an orbiting ring rotatably mounted on the eccentric for rotation about an axis offset from the shaft axis, a cylindrical post coaxial with the axis of the housing passages for carrying gas to and from the compression chamber, vanes movable radially with respect to the orbiting ring, and pressure sensitive valves that open exhaust passages from the compression chamber. The orbiting ring rotates in continual contact with the inner surface of the housing and the outer surface of the cylindrical post. Compression occurs within a first stage space and a second stage space, each space divided into compression chambers by the sliding vanes and contact between the ring and post or between the ring and housing.

12 Claims, 6 Drawing Sheets

MULTIPLE STAGE ORBITING RING ROTARY COMPRESSOR

BACKGROUND OF THE INVENTION

1. Field of the Invention

This invention relates to the field of gas compressors, especially to compressors for air conditioning systems. The invention pertains to gas compressors of the type having orbiting rings or rolling pistons.

2. Description of the Prior Art

A conventional rotary compressor is constructed so that a crankshaft having an eccentric part is driven in a cylinder by a motor. A rolling piston fitted to the eccentric part compresses refrigerant gas inducted into the cylinder. A compression chamber is formed inside the cylinder between its axial ends and a vane, which is slidably held by the cylinder and has an end portion contacting the outer surface of the rolling piston. Rotary compressors of this general type are described in U.S. Pat. Nos. 4,219,314; 4,636,152; 4,452,570; 4,452,571; 4,507,064; 4,624,630; and 4,780,067.

A discharge valve for use in a rotary compressor of this type is described in U.S. Pat. No. 4,628,963. The valve includes a leaf spring and a flexible valve plate which opens and closes a discharge port. A vane operating in a rotary compressor is described in U.S. Pat. No. 4,086,042. The vane includes a pivotal shoe joined by a socket connection to the vane. The moving surface of the piston is contacted by the vane shoe.

A technique for modulating the capacity of a rotary compressor is described in U.S. Pat. No. 4,558,993.

A technique for manufacturing a rolling piston rotary compressor is described in U.S. Pat. No. 4,782,569.

A scroll-type gas compressor is described in U.S. Pat. No. 4,781,549. This compressor includes symmetrical scroll members encircling one another in one wrap. The ends of the wrapped members provide continued sealing between the scroll members. The compressor includes a discharge valve that allows a range of pressure ratios to be produced.

SUMMARY OF THE INVENTION

Within a few years, a class of air conditioning coolants, hydrofluorocarbons such as R134A, will be used commercially in place of chlorofluorocarbons currently in use. The new coolants operate at substantially higher pressures, perhaps 10–15% higher than conventional coolants, and do not mix as well with lubricating oil as do conventional coolants.

Due to the higher operating pressures required, seals between inlet and compression chambers of gas compressors must be improved. A two stage compressor, such as one of the type of the present invention, has a higher volumetric efficiency than piston compressors. In piston compressors, the suction and compression chambers are adjacent; therefore, they are susceptible to cross flow of coolant from the suction port to discharge port. Also, elevated temperatures of the compression chamber preheats the inlet gas. Preheating the inlet gas reduces the charge or mass of low pressure gas inducted into the compressor, and cross flow reduces exhaust gas pressure. As a consequence of this, the overall efficiency of piston compressors is less than theoretically possible.

Rotary compressors, which operate at higher pressure and slower speeds than piston compressors, are susceptible to loss of overall operating efficiency due to internal leakage resulting from higher compression. Also, high pressure gas is present in the vicinity of an internal seal for a longer period due to the slower speed. The two-stage rotary compressor according to this invention reduces by approximately half the pressure difference across the rotary mechanism and is sealed better than conventional rotary compressors to avoid internal linkage problems.

Rotary compressors of the scroll-type are inherently more complex, and more difficult to machine and to assemble than conventional piston compressors or the rotary compressor according to this invention. In addition, because of the complexity of machining required to produce scroll-type rotary compressors, the cost of fabrication is substantially higher than rotary compressors.

These desirable characteristics are realized and the problems of the prior art avoided with the rotary compressor of the present invention. It includes a housing defining an interior cylindrical space within which multiple stages of compression occur. A cylindrical post is located within the housing concentric with the axis of the housing. An orbiting piston, located between the cylindrical post and the housing wall, is mounted for rotation about an axis that is offset from the axis of the post and interior housing surface so that the outer surface of the orbiting ring contacts the inner surface of the housing and the inner surface of the orbiting ring contacts the outer surface of the post. External vanes, mounted slidably on the housing in a generally radial direction, divide a first space within which the first stage of compression occurs into first and second chambers. Inner vanes, mounted slidably on the post for movement in a generally radial direction, divide a second space where the second stage of compression occurs into third and fourth chambers. Furthermore, as the locations of contact of the orbiting ring with the housing and the post rotate due to the offset axis of the orbiting ring with respect to that of the crankshaft, the first, second, third and fourth chambers are divided and dynamically sealed by these rotating points of contact.

Internal porting carries gas at suction pressure from an inlet port through the housing to suction ports, which are opened and closed by the variable position of the external vanes maintained in contact with the outer surface of the orbiting ring. Gas discharged from the first compression stage and the second compression stage is controlled by operation of reed valves mounted on a valve plate at one axial end of the compression chamber. Gas discharged from the first stage is directed through inlet ports to the second stage along cylindrical passages adjacent the internal vanes. Gas discharged from the second stage of compression leaves the second compression chamber under the control of a second set of valves that open and close communication between the third and fourth chambers. The internal and external vanes are formed with pockets adjacent corresponding inlet ports. The positions of the vanes and their pockets change in relation to the inlet ports in accordance with the radially variable position of the orbiting ring. In this way, the vanes open and close the inlet ports in a regulated action that is coordinated with position of the orbiting ring and pressure within the volumes of the first and second compression stages.

DESCRIPTION OF THE PREFERRED EMBODIMENT

Figure 1:
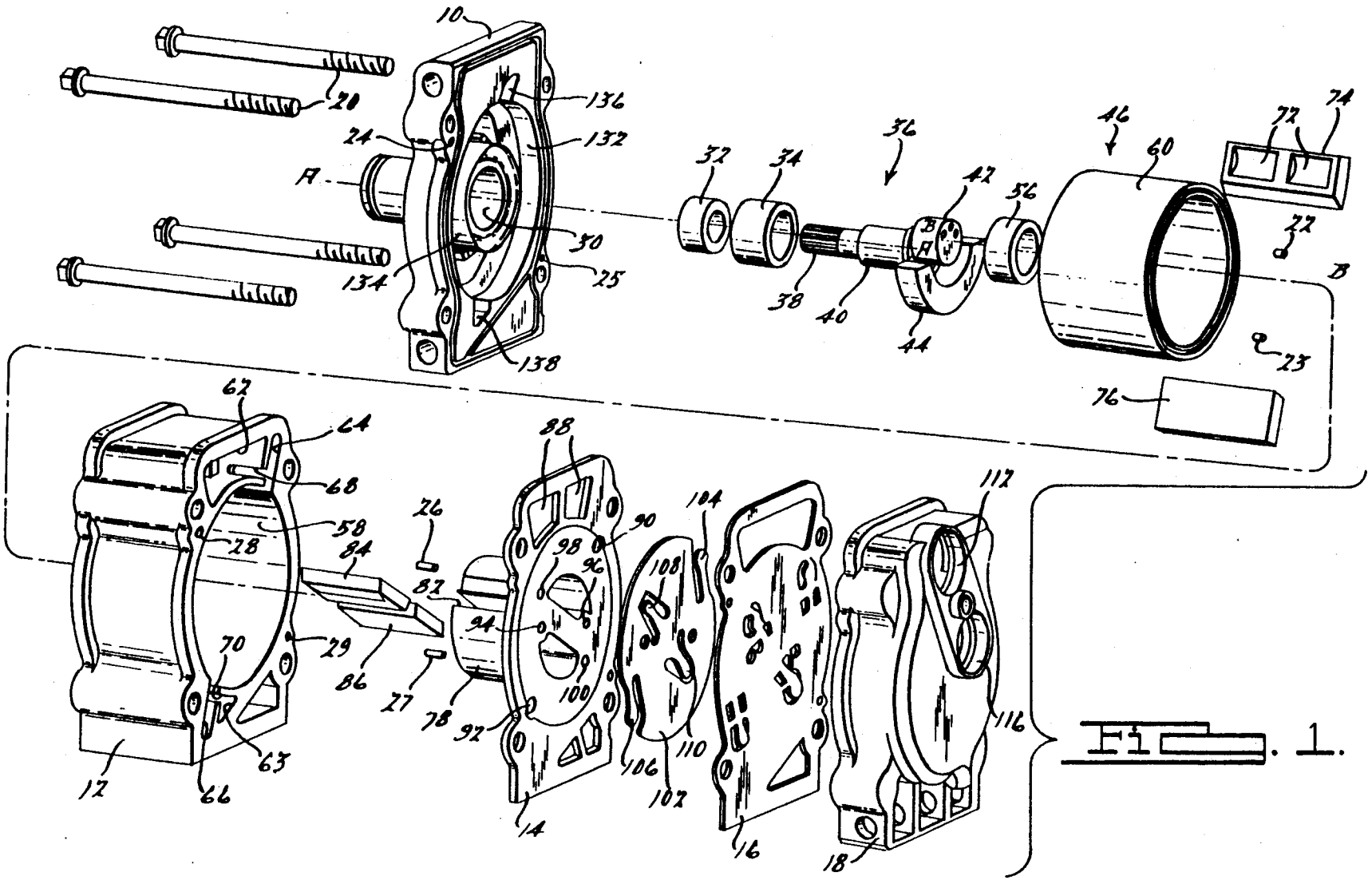
FIG. 1 is an isometric view showing components of the compressor displaced axially from one another and arranged generally in the order of assembly.
Figure 2:
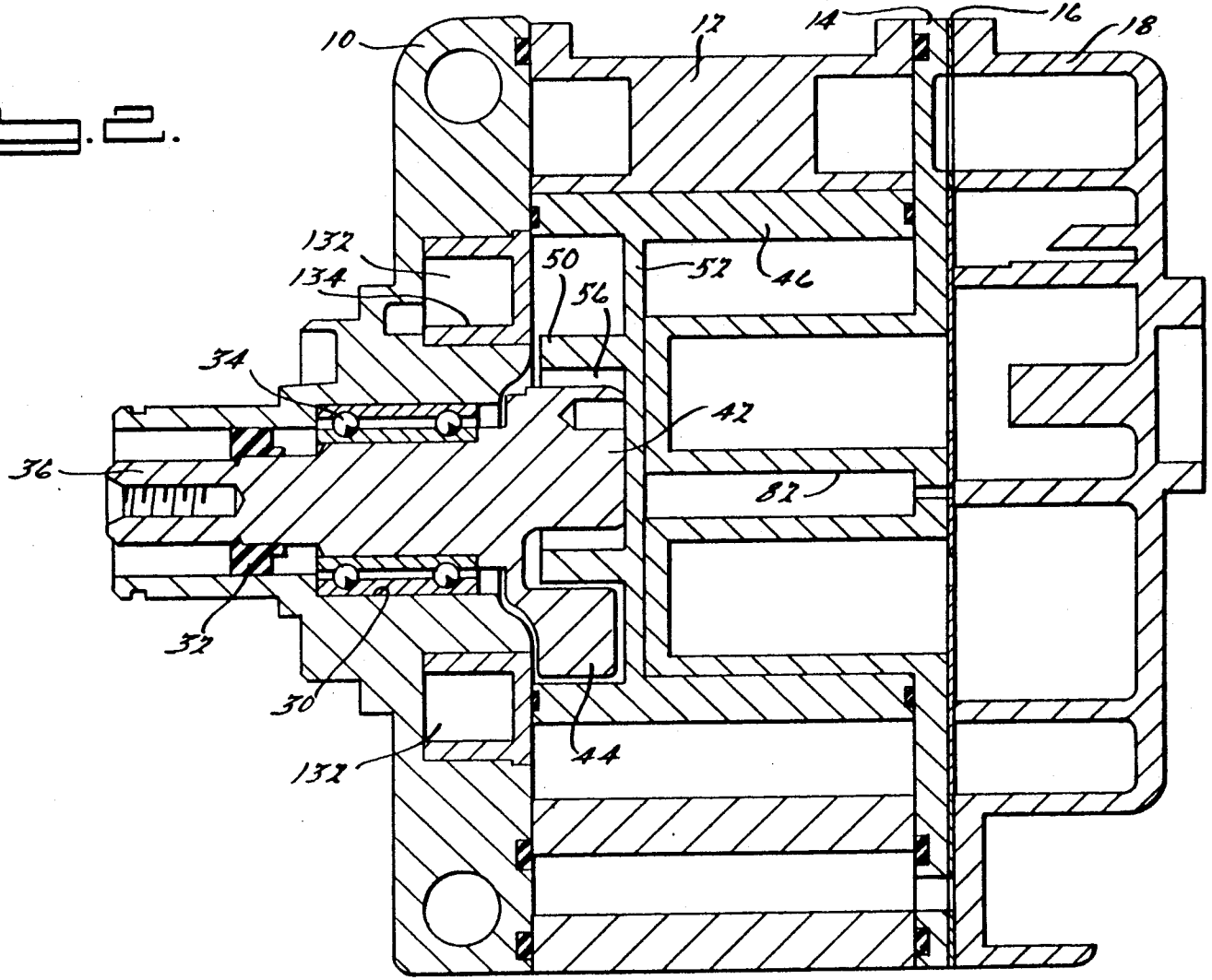
FIG. 2 is a cross section taken at a vertical plane through an assembled compressor with certain elements deleted for the purpose of clarity.

Referring first to FIG. 1, the housing of a gas compressor includes a front head 10, center housing 12, rear gasket 16 and rear head 18. These components and rear plate 14 are mutually connected by passing tension bolts 20 through four aligned bolt holes formed in each of the components and by engaging threads tapped in the rear head. Dowel pins 22, 23 located within alignment holes 24, 25 establish and maintain the angular position of the front head relative to the center housing. Dowel pins 26, 27 located within holes 28, 29 in the rear face of the center housing, the rear plate gasket and front face of the rear head establish and maintain the angular relative position among these components.

The front head includes a cylindrical bore 30 having a small diameter sized to receive a hydraulic seal 32 and a larger diameter sized to receive roller bearing 34. The bearing rotatably supports a crankshaft 36, which includes a spline surface 38 for drivably connecting the crankshaft to the sheave of a drivebelt assembly, a cylindrical shoulder 40 fitted within the bearing concentric with axis A—A, eccentric 42 having a cylindrical surface whose axis B—B is offset radially from axis A—A, and a large cylindrical surface 44 coaxial with A—A.

Figure 3:
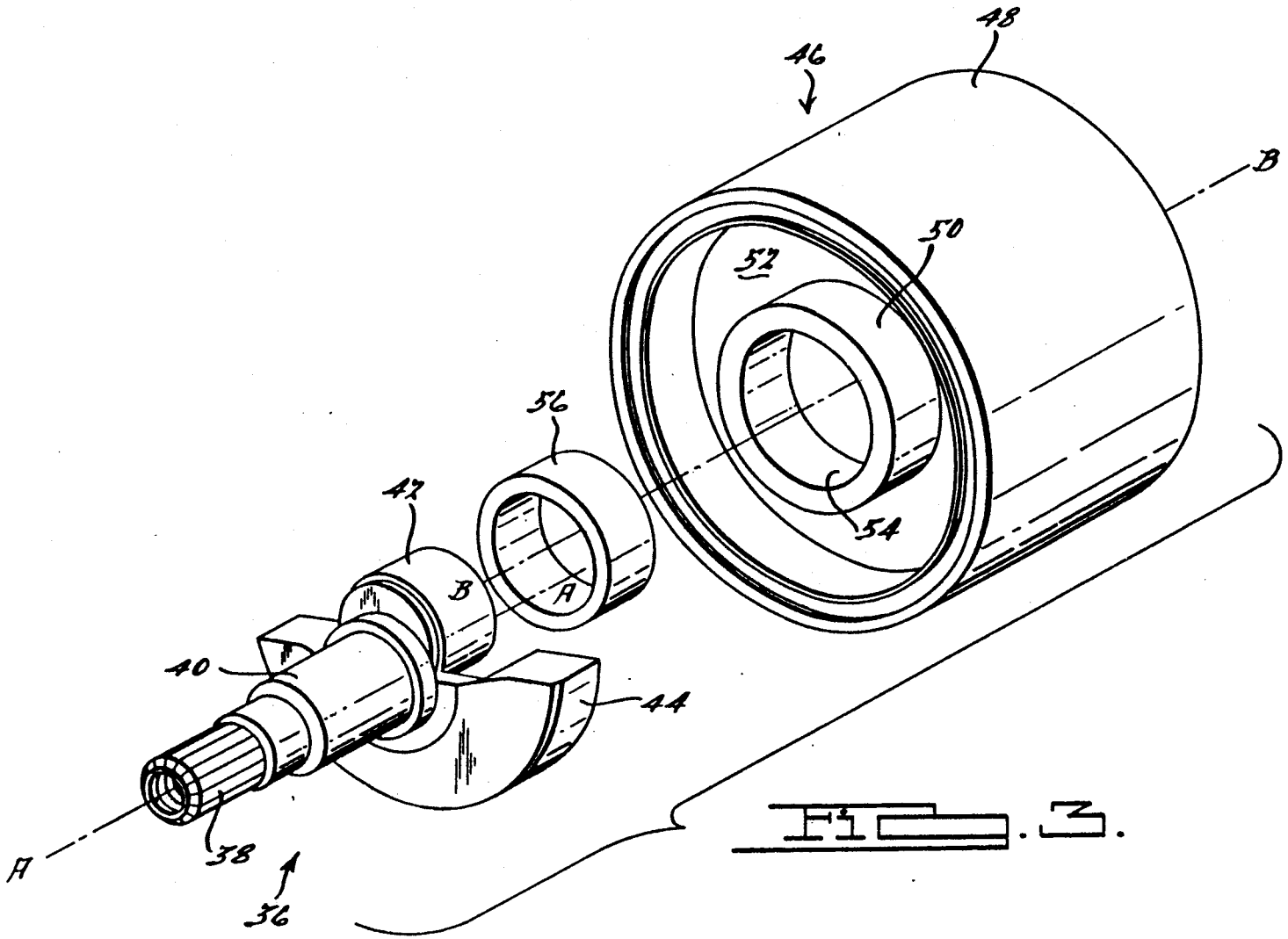
FIG. 3 is an isometric view showing the front face of the orbiting ring, bushing and countershaft.

Referring next to FIG. 3, an orbiting ring 46 includes a cylindrical outer surface 48 coaxial with B—B, a cylindrical boss 50 joined by a web 52 to the outer surface defines a central bore 54 concentric with axis B—B. Bushing 56 is fitted within bore 54 and rotatably supports eccentric 42 on the orbiting ring.

FIG. 1 shows a center housing 12 that includes a cylindrical inner surface 58 on which the outer cylindrical surface 48 of the orbiting ring rolls, a suction passage 62 through which incoming low pressure gas flows, and outer vane slots 64, 66 in which vanes 84, 86 slide into contact with the outer surface of the orbiting ring. Inlet passages 68, 70, communicating respectively with passages 62, 63, carry refrigerant at suction pressure to inlet pockets 72, 73 formed on the lateral, inner faces of the outer vanes 74, 76, respectively.

Figure 4:
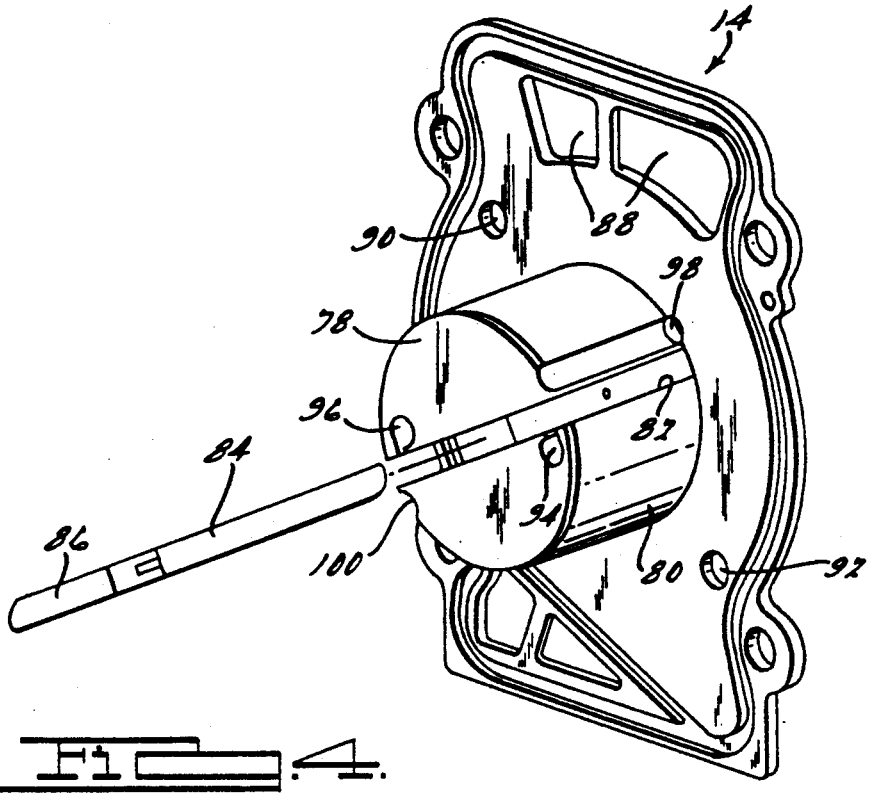
FIG. 4 is an isometric view showing the front face of the center housing.

Referring now to FIGS. 1 and 4, rear plate 14 includes a post 78 having an outer cylindrical surface 80 coaxial with axis A—A, sized to fit within the orbiting ring and located within center housing 12. The post contains a transverse diametric slot 82, within which internal vanes 84, 86 are mounted for sliding radially directed movement into contact with the inner surface of the orbiting ring. The rear plate also includes a suction passage 88 aligned with passage 62, first stage-discharge passages 90, 92, intermediate or second-stage inlet passages 94, 96, and second stage discharge passages 98, 100.

A valve plate 102, formed of spring steel, seats within a circular recess formed on the rear face of plate 14 and defines four reed valves: first and second first stage discharge valves 104, 106 for opening and closing passages 90, 92; and first and second stage discharge valves 108, 110 for opening and closing passages 98, 100. The reed valves operate on the basis of pressure difference across the valves to open and close corresponding passages. The valves open by bending valve tabs 104, 106, 108, 110 through their thicknesses of the spring steel sheet. As the pressure difference across the valve declines, the degree to which the corresponding passages are opened by the valve decrease due to resilience of the steel sheet and its tendency to close the corresponding passage when the pressure difference is removed.

Located between the adjacent faces of the rear head and rear plate, gasket 16 seals the periphery of the four tension bolt holes, and two dowel holes and the passages opened and closed by the four reed valves, viz. the intermediate pressure passage and inlet or suction passages.

Figure 5:
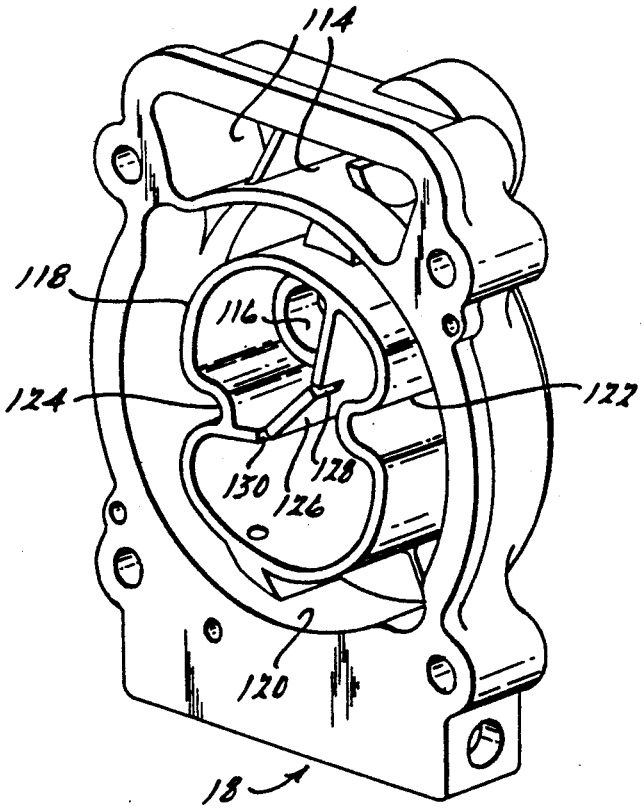
FIG. 5 is an isometric view showing the interior face of the rear head.

Referring next to FIGS. 1 and 5, rear head 18 includes a suction port 112, suction passage 114, aligned and communicating with suction passage 88 and 62, and discharge port 116 communicating with the interior of waisted cylinder 118 integrally cast with the body of the rear head. Surrounding cylinder 118, the walls of the rear head define a space located within the inner surface 120 of the side walls of the rear head. First stage discharge pressure gas flows through passages 122, 124 defined by the waist of cylinder 118. Passages 122, 124 are aligned with intermediate pressure passages 94, 96 formed through the thickness of rear plate 14 and the length of post 78, through which gas compressed in the first stage is carried to and enters the second stage. The volume defined by the walls of cylinder 18 is divided by a baffle 126 defining slots 128, 130. The interior volume of cylinder 118 is divided by the baffle into two portions, each portion communicating with second stage discharge passages 98, 100. The slots in the baffle provide means for passages 98, 100 to maintain communication with discharge port 116 through which gas at discharge pressure leaves the compressor.

The rear face of front head 10 defines an annular passage 132 located between the inner surface of its wall and the outer surface of journal 134, on which the crankshaft is rotatably supported. Passage 132 connects suction passage 136, which communicates with suction passages 62, 88, 114, to first stage inlet passage 138, which communicates with inlet passage 63 formed in the center housing. In this way, suction pressure is continually present in inlet passages 68, 70 and is communicated through the recesses or pockets 72, 73 formed on the surfaces of the outer vanes, through which gas at suction pressure is admitted to the first stage.

Operation of the compressor is described with reference to FIGS. 6A–6H, cross sections through the center housing of an assembled rotary compressor according to this invention. The first stage of compression occurs in a first space bounded by inner surface 58 of the housing and outer surface 48 of the orbiting ring. This space is divided by the outer vanes, which are urged by pressure or spring forces applied to their ends into continuous contact with the orbiting ring, into first and second chambers 152, 154. The location of contact 156 of the ring and housing divides chamber 152 into volumes 142, 146 and divides chamber 154 into volumes 140, 144, whose capacities continually change as the orbiting ring rolls on surface 58 due to its driving engagement with eccentric 42 of the crankshaft.

The second stage of compression occurs in a second space bounded by the inner surface of the orbiting ring and the cylindrical surface 80 of post 78. The inner vanes, which are urged radially outward against the ring by pressure supplied to the post slot between the ends of the vanes, divide this space into third and fourth chambers 160, 162. The location of contact 172 of the ring and post divides chamber 160 into volumes 164, 166 and divides chamber 162 into volumes 168, 170, whose capacities vary continually as the orbiting ring rotates on surface 80.

The first stage of compression is described next beginning with reference to FIGS. 6A. Vane 76 is forced radially outward by contact with the ring so that volume 144 is very small, volume 140 larger, and volume 142 still larger. With the compressor disposed in this way, suction passage 70 is closed by vane 76, volume 142 is open to suction passage 68 and is closed at first stage discharge passage 92 by the action of reed valve 106. Volume 140 may be open to first stage discharge passage 90 subject to control of reed valve 104.

Figure 6A:
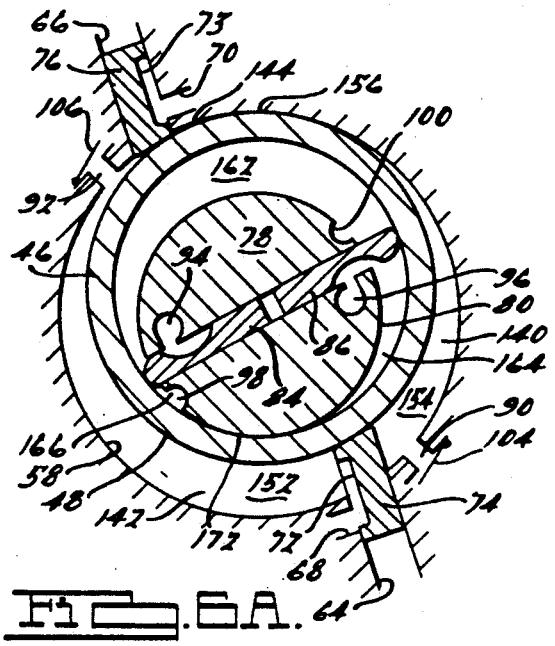
FIGS. 6A–6H show operation of vanes, valves and the orbiting ring of the rotary compressor at successive angular positions of the crankshaft.
Figure 6B:
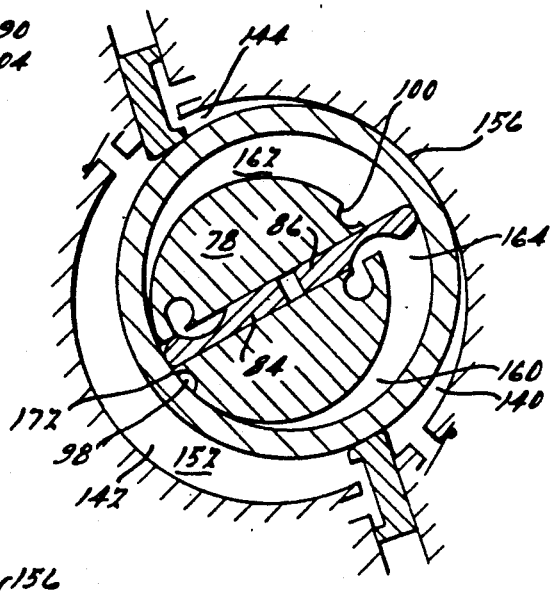

As the orbiting ring moves on surface 58 to the position of FIG. 6B, volume 144 enlarges and vane 76 opens passage 70 to that volume. Pressure rises within volume 140 because its volume decreases due to movement of the ring and contact point 156. Reed valve 104 slowly opens as the pressure within volume 140 rises. Pressure in volume 142 is suction pressure because vane 74 maintains communication with passage 68. The size of this volume increases due to the positional change of the orbiting ring.

Figure 6C:
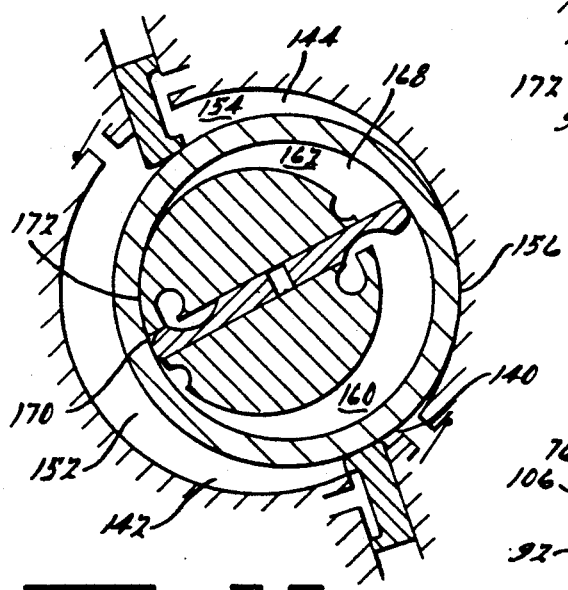
Figure 6D:
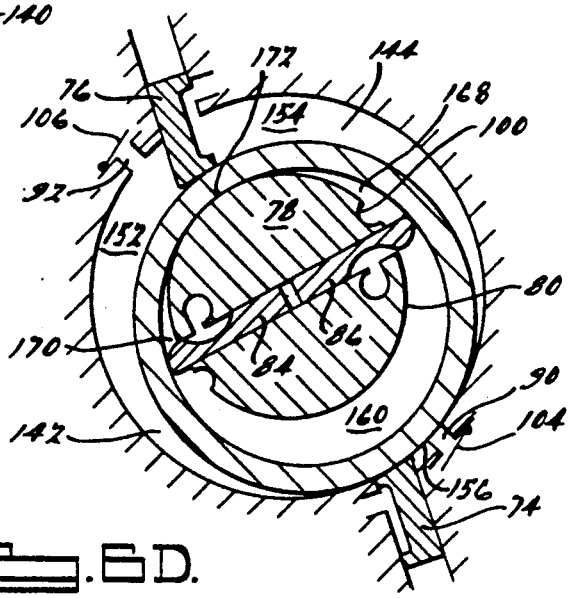

As the orbiting ring and point 156 rotate to the position of FIG. 6C, high pressure gas in volume 140 discharges through passage 90 due to compression occurring there as volume 140 contracts. Compression begins to occur in volume 142 because suction passage 68 closes and volume 142 reduces. Volume 144 expands at discharge pressure due to communication with the suction port through passage 70. When the orbiting ring rotates to the position shown in FIG. 6D, volume 140 becomes nearly zero and its contents discharge through passage 90 because point 156 is nearly coincident with the location of contact between vane 74 and the orbiting ring. Meanwhile, pressure within volume 142 increases as its volume declines before discharge passage 92 is opened by reed valve 106. Volume 144 continues to expand at suction pressure supplied through passage 70 and the pockets formed on vane 76.

FIGS. 6E–6H show that compression continues in volume 142 as its volume decreases due to movement of point 156, and the ring rotates on the housing surface. Eventually, pressure within volume 142 opens valve 106 and allows compressed gas within volume 142 to discharge through passage 92. When the orbiting ring moves to the position of FIGS. 6H, point 156 is so close to the location of contact of vane 76 and the orbiting ring that volume 142 will have substantially disappeared.

Figure 6E:
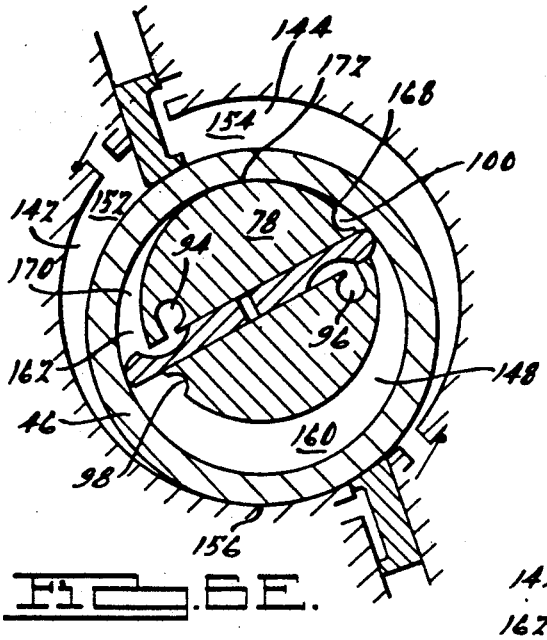

Meanwhile, volume 144 reaches a maximum, suction passage 70 closes (at FIG. 6G), compression occurs in volume 144, and valve 104 eventually opens discharge passage 90. Volume 146 appears first in FIG. 6F where it is shown open to suction passage 68. Its volume continues to expand, as seen in FIGS. 6G and 6H while suction port 68 remains open.

Figure 6F:
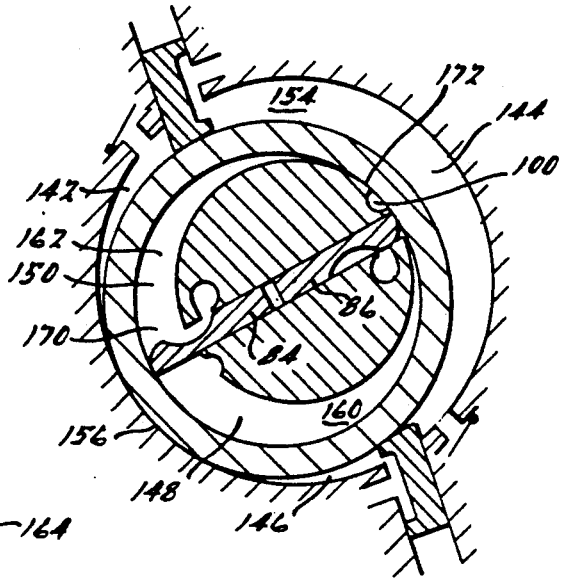
Figure 6G:
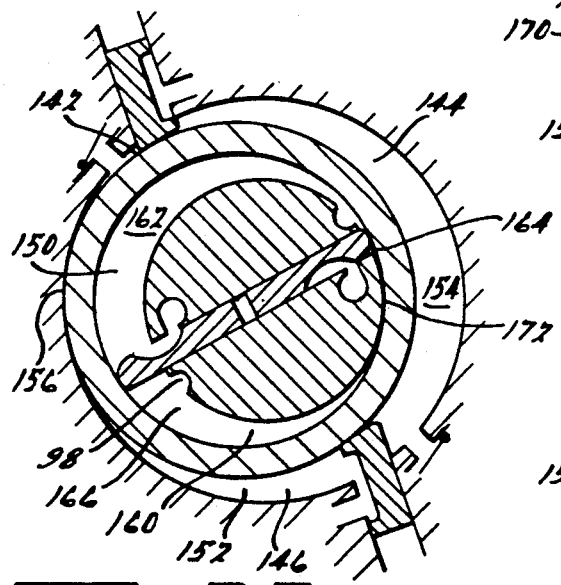
Figure 6H:
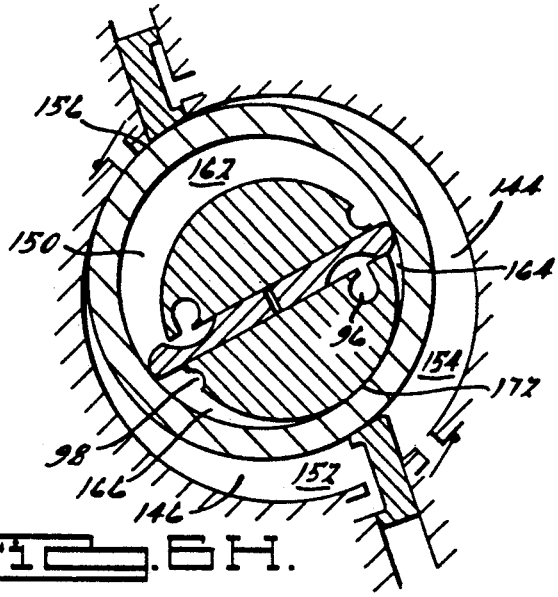

The relative positions of the components of the compressor in FIG. 6H are shown slightly later in the position of FIG. 6A. Notice that volume 146 of FIG. 6H corresponds to volume 142 of FIG. 6A, volume 144 of FIG. 6H corresponds 140 of FIG. 6A and volume 142 of FIG. 6H, which has substantially disappeared in that figure, corresponds to volume 144 of FIG. 6A.

Gas at first stage discharge pressure flows axially along passages 90, 92 through the corresponding reed valves 104, 106 to the space between cylinder 118 and the inner surface of rear housing 18. There the gas flows in the opposite axial direction through intermediate passages 122, 124, intermediate pressure passages 94, 96 of rear plate 14, and pockets on vanes 84, 86, and enters the second space where the second stage of compression occurs.

With the components of the compressor in the position shown in FIG. 6A, chamber 160 is divided into volumes 164, 166 due to contact between the post and the orbiting ring at point 172. Volume 164 contains gas at intermediate pressure because of the open communication with intermediate pressure supply passage 96. Volume 166 contains compressed gas at second state discharge pressure, which causes valve 108 to open passage 98. When the orbiting ring moves to the position of FIG. 6B, point 172 on the post moves substantially to the location of vane 84; therefore, volume 166 decreases to zero and reed valve 108 closes passage 98. Meanwhile, volume 164 continues to expand with gas at intermediate pressure. When contact point 172 passes vane 84, chamber 162 divides into volumes 168 and 170, which progressively decrease and increase, respectively, as the orbiting ring rotates to the position of FIG. 6D. While this occurs, gas in volume 168 compresses to a magnitude that causes valve 110 to deflect and open exhaust passage 100, and the gas pressure in volume 170 goes slightly negative until intermediate passage 94 opens, as shown in FIG. 6E.

As the orbiting ring rotates to the position of FIG. 6F where the point of contact 172 moves closer to vane 86, compressed gas in volume 168 is forced out exhaust passage 100, and volume 170 fills with gas at intermediate pressure. As the orbiting ring rotates from the position of FIG. 6D to that of FIG. 6E, passage 96 closes as vane 86 moves radially inward on post 78, and valve 108 closes exhaust passage 98. Progressive rotation of the orbiting ring causes chamber 160 to contract, thereby compressing the gas in the chamber, and divides the chamber into volumes 164, 166 after contact point 172 passes vane 86.

When the orbiting ring moves to the position of FIG. 6H, gas pressure in volume 164 is slightly negative due to expansion of the volume with port 96 closed. However, as rotation continues to the position of FIG. 6A, passage 96 opens and volume 164 fills with gas at intermediate pressure. Volume 166 contracts, thereby compressing the gas within that space, until the magnitude of the pressure opens vane 108 permitting gas to discharge at second stage discharge pressure.

This process of expansion of the volumes, closure of the inlet passage, compression, and opening of the exhaust passages continues as the cycle repeats and orbiting ring 46 moves again to the position shown in FIG. 6A.

Having described a preferred embodiment of our invention, what we claim and desire to secure by U.S. Letters Patent is:

1. A rotary compressor comprising:

a housing fixed against rotation, defining an interior surface having a first axis;

a post substantially coaxial with the first axis, located within, and spaced radially from, the interior surface of the housing;

a ring mounted for planetary rotation about an axis radially displaced from the first axis, located within the housing between its interior surface and the post, having a first surface generally spaced from and locally contacting the interior surface of the housing at a first location of contact, and a second surface generally spaced from and locally contacting the post at a second location of contact;

outer vanes contacting the first surface of the ring at angularly spaced locations, dividing a first space bounded by the interior surface of the housing and the first surface of the ring into first and second chambers;

inner vanes contacting the second surface of the ring at angularly spaced locations, dividing a second space bounded by the post and the second surface of the ring into third and fourth chambers;

passage means for carrying fluid to and from the first and second spaces;

valve means for opening and closing communication between the passage means and the first and second spaces; and a crankshaft mounted for rotation substantially about the first axis, having eccentric means driveably engaged with the ring and offset radially from the first axis for driving the ring in planetary rotation about the first axis.

2. A rotary compressor comprising;

a housing fixed against rotation, defining an interior surface having a first axis;

a post substantially coaxial with first axis, located within, and spaced radially from, the interior surface of the housing, a ring mounted for planetary rotation about an axis radially displaced from the first axis, located within the housing between its interior surface and the post, having a first surface generally spaced from and locally contacting the interior surface of the housing at a first location of contact, and a second surface generally spaced from and locally contacting the post at a second location of contact;

outer vanes contacting the first surface of the ring at angularly spaced locations, dividing a first space bounded by the interior surface of the housing and the first surface of the ring into first and second chambers, each outer vane supported in a housing slot for sliding movement toward and away from the ring;

inner vanes contacting the second surface of the ring at angularly spaced locations, dividing a second space bounded by the post and the second surface of the ring into third and fourth chambers, each inner vane supported in a slot formed in the post for sliding movement toward and away from the ring;

first stage inlet passages opened and closed by movement of the outer vanes in the housing slots; and second stage inlet passages opened and closed by movement of the inner vanes in the post slot; and valve means for opening and closing communication between the passage means and the first and second spaces.

3. The compressor of claim 2 further comprising means for urging the inner and outer vanes into contact with the first and second surfaces of the ring.

4. The compressor of claim 2 further comprising:

means for urging the inner and outer vanes into contact with the first and second surfaces of the ring, and wherein the post has a slot directed toward the second surface of the ring;

the housing has angularly spaced slots directed toward the first surface of the ring;

each outer vane is supported in a housing slot for sliding movement toward the ring and;

the inner vanes are supported in the post slot for sliding movement in opposite directions toward the inner surface of the ring.

5. The compressor of claim 2 wherein the first and second locations of contact are mutually substantially diametrically opposite.

6. The compressor of claim 2 wherein:

the first location of contact divides the first and second chambers into volumes whose capacities vary as the position of the first location of contact varies; and the second location of contact divides the third and fourth chambers into volumes whose capacities vary as the position of the second location of contact varies.

7. The compressor of claim 2 wherein:

the passage means includes first discharge passages; communicating with the first and second chambers, located adjacent each outer vane; second discharge passages, located adjacent each inner vane, communicating with the third and fourth chambers; and the valve means includes first valves located adjacent each first discharge passage, adapted to close said passages when the differential pressure across the valve is relatively small and to open said passages as said differential pressure increases in magnitude, and second valves located adjacent each second discharge passages, adpated to close said passages when the differential pressure across the valve is relatively small and to open said passages as said differential pressure increases in magnitude.

8. A rotary compressor comprising;

a housing fixed against rotation, defining an interior surface having a first axis;

a post substantially coaxial with first axis, located within, and spaced radially from, the interior surface of the housing, and having a slot;

a ring mounted for planetary rotation about an axis radially displaced from the first axis, located within the housing between its interior surface and the post, having a first surface generally spaced from and locally contacting the interior surface of the housing at a first location of contact, and a second surface generally spaced from and locally contacting the post at a second location of contact;

an outer vane mounted on the housing, contacting the first surface of the ring, extending into a first space bounded by the interior surface of the housing and the first surface of the ring, supported in a housing slot for sliding movement toward and away from the ring;

an inner vane mounted on the post, contacting the second surface of the ring, extending into a second space bounded by the post and the second surface of the ring, supported in the post slot for sliding movement toward and away from the ring;

first inlet passages opened and closed by movement of the outer vane in the housing slot; and second inlet passages opened and closed by movement of the inner vane in the post slot; and valve means for opening and closing communication between the first and second spaces.

9. The compressor of claim 8 wherein:

the first location of contact divides the first space into first and second chambers whose capacities vary as the position of the first location of contact varies; and the second location of contact divides the second space into third and fourth chambers whose capacities vary as the position of the second location of contact varies.

10. The compressor of claim 8 wherein:

the passage means includes a first discharge passage communicating with the first and second chambers, located adjacent the outer vane; a second discharge passage, located adjacent the inner vane, communicating said passage with the third and fourth chambers; and the valve means includes a first valve, adapted to close said the first discharge passage when the differential pressure across the first valve is relatively small and to open said passage as said differential pressure increases in magnitude, and a second valve, adapted to close said second discharge passage when the differential pressure across the valve is relatively small and to open said passage as said differential pressure increases in magnitude.

11. A rotary compressor comprising:

a housing fixed against rotation, defining an interior surface having a first axis;

a post substantially coaxial with the first axis, located within, and spaced radially from, the interior surface of the housing;

a ring mounted for planetary rotation about an axis radially displaced from the first axis, located within the housing between its interior surface and the post, having a first surface generally spaced from and locally contacting the interior surface of the housing at a first location of contact whose position changes as the ring rotates, and a second surface generally spaced from and locally contacting the post at a second location of contact whose position changes as the ring rotates;

an outer vane contacting the first surface of the ring, substantially sealing a first space bounded by the interior surface of the housing and the first surface of the ring at a fixed angular position, the first location of contact substantially sealing said first space at an angularly variable position;

an inner vane contacting the second surface of the ring, substantially sealing a second space bounded by the post and the second surface of the ring at a fixed angular position, the second location of contact substantially sealing said second space at an angularly variable position;

passage means for carrying fluid to and from the first and second spaces including:

a first discharge passage communicating said passage with the first and second chambers; a second discharge passage communicating said passage with the third and fourth chambers; and valve means for opening and closing communication between the passage means and the first and second spaces including a first valve, adapted to close said first discharge passage when the differential pressure across the first valve is relatively small and to open said port as said differential pressure increases in magnitude, and a second valve, adapted to close said second discharge passage when the differential pressure across the first valve is relatively small and to open said port as said differential pressure increases in magnitude.

12. The compressor of claim 11 wherein:

a first volume of the first space located between the outer vane and the first location of contact expands as the ring rotates and a second volume of the first space located between the outer vane and the first location of contact contracts as the ring rotates; and a third volume of the second space located between the inner vane and the second location of contact expands as the ring rotates and a fourth volume of the second space located between the inner vane and the second location of contact contracts as the ring rotates.

* * * * *